US006319086B1

(12) United States Patent
Shen

(10) Patent No.: US 6,319,086 B1
(45) Date of Patent: Nov. 20, 2001

(54) HULA HOOP WITH ROTARY BALLS

(76) Inventor: Cherng-Yuh Shen, 1F No.257 Chungson Road, Chungleen City (TW)

( * ) Notice: Subject to any disclaimer, the term of this patent is extended or adjusted under 35 U.S.C. 154(b) by 0 days.

(21) Appl. No.: 09/625,207

(22) Filed: Jul. 24, 2000

(51) Int. Cl.[7] ..... A63H 33/02
(52) U.S. Cl. ..... 446/236; 601/132
(58) Field of Search ..... 446/28, 236; 482/110, 482/131; 601/132, 118

(56) References Cited

U.S. PATENT DOCUMENTS 5,492,526 * 2/1996 Chen ..... 446/236 X
5,997,449 * 12/1999 Lee ..... 446/236 X
6,056,621 * 5/2000 Lin ..... 446/236
6,102,769 * 8/2000 Huang ..... 446/236
6,109,999 * 8/2000 Kuo ..... 446/236

* cited by examiner

*Primary Examiner*—John A. Ricci
(74) *Attorney, Agent, or Firm*—Harrison & Egbert

(57) ABSTRACT

A hula hoop having a plurality of arc frames joined in end-to-end relationship so as to form a circular configuration. Each of the arc frames has a top arc unit and a bottom arc unit mechanically affixed together. Each of the arc frames has an undulating inner surface. A spherical ball is rotatably mounted within the arc frame so as to have a surface extending outwardly of the inner surface.

3 Claims, 5 Drawing Sheets

HULA HOOP WITH ROTARY BALLS

BACKGROUND OF THE INVENTION

1. Field of the Invention

The present invention relates to a hula hoop, used for doing exercises so as to lost one's fat and build one's body.

2. Description of the Related Art

In the modern world, people eat a great variety of extravagant foods; that is, they want to eat many different kinds of food, including somethings they never ate before. The extravagant food often means food of pure taste and way of preparing from a particular place or country. It does not mean food for a man's nutritional balance. As a result, today people eat too much, have indigestion, and are careless about their diet because of taking too much of certain kinds of nutrients. Therefore, children's amusements such as rope skipping and hula hoop are used for doing exercises so as to lose one's fat and build one's body.

As demand for hula hoops increases greatly in the market, there is a new hula hoop structure with an arc body (A") stretching on the inner side of the hoop which is different from the conventional simple collar body (A'); however, the new hoop is made by plastics gas blowing and injection mono-block molding. (see FIG. 1)

Although diameter of the hoop body is only 1–1.5 dm, the diameter of the whole hoop collar is 30–40 dm, which is rather big and needs a big mold. The inventor of the present invention studies hard and tries to improve the structure of a conventional hoop.

BRIEF SUMMARY OF THE INVENTI0N

The feature of the present invention lies in that the hula hoop is comprised of a plurality of corresponding arc units which can be pivoted and combined to form a collar hoop with a plurality of rotary balls, such that rotary balls disposed on the pivoted and combined units with stream-line corresponding arc bodies on the inner side of the hoop can rotate on one's waist or hip to provide a massage function.

DETAILED DESCRIPTION OF THE INVENTION

Figure 1:
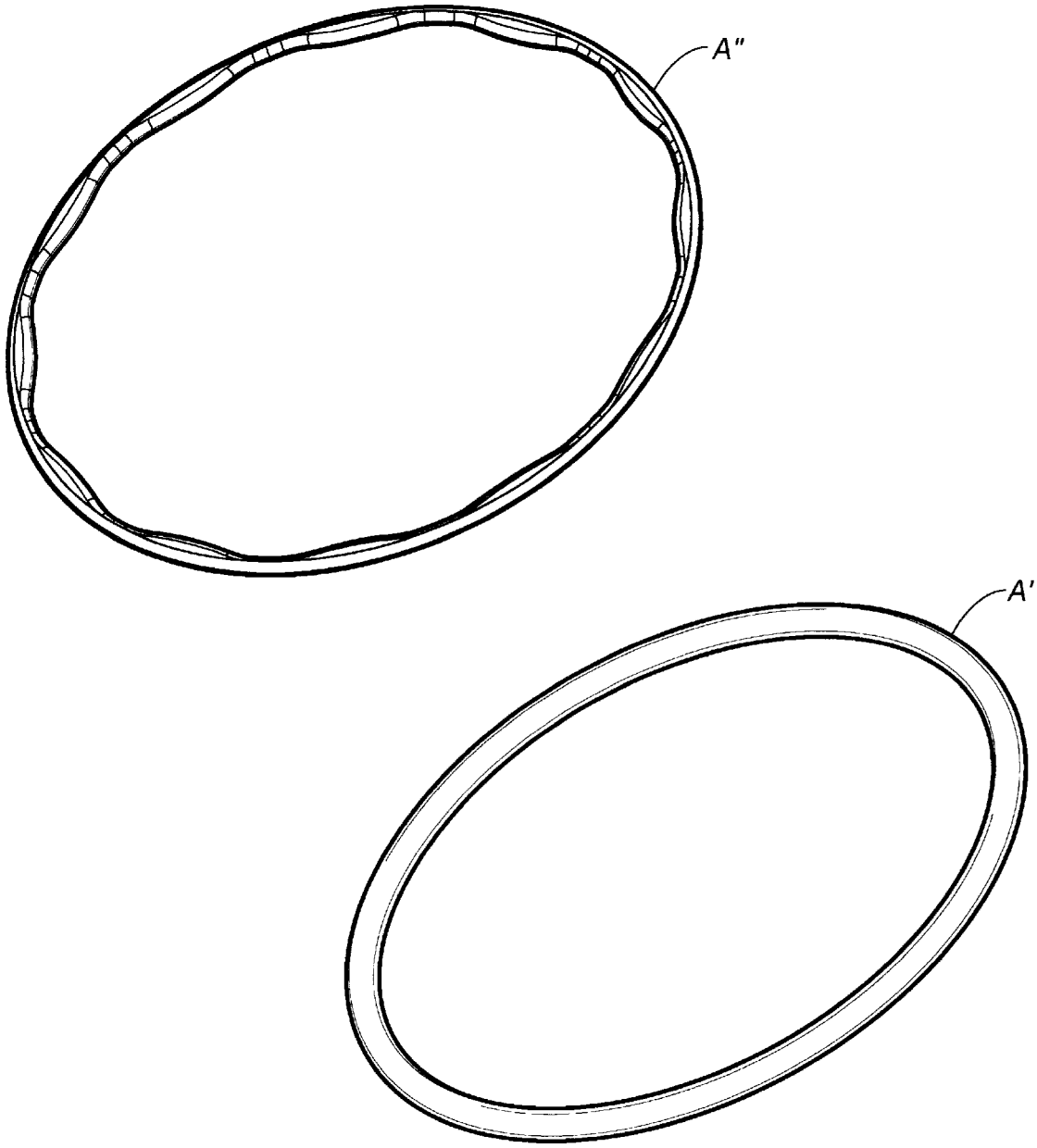
FIG. 1 Prior Art
FIG. 1 is a schematic view of a conventional hula hoop.
Figure 2:
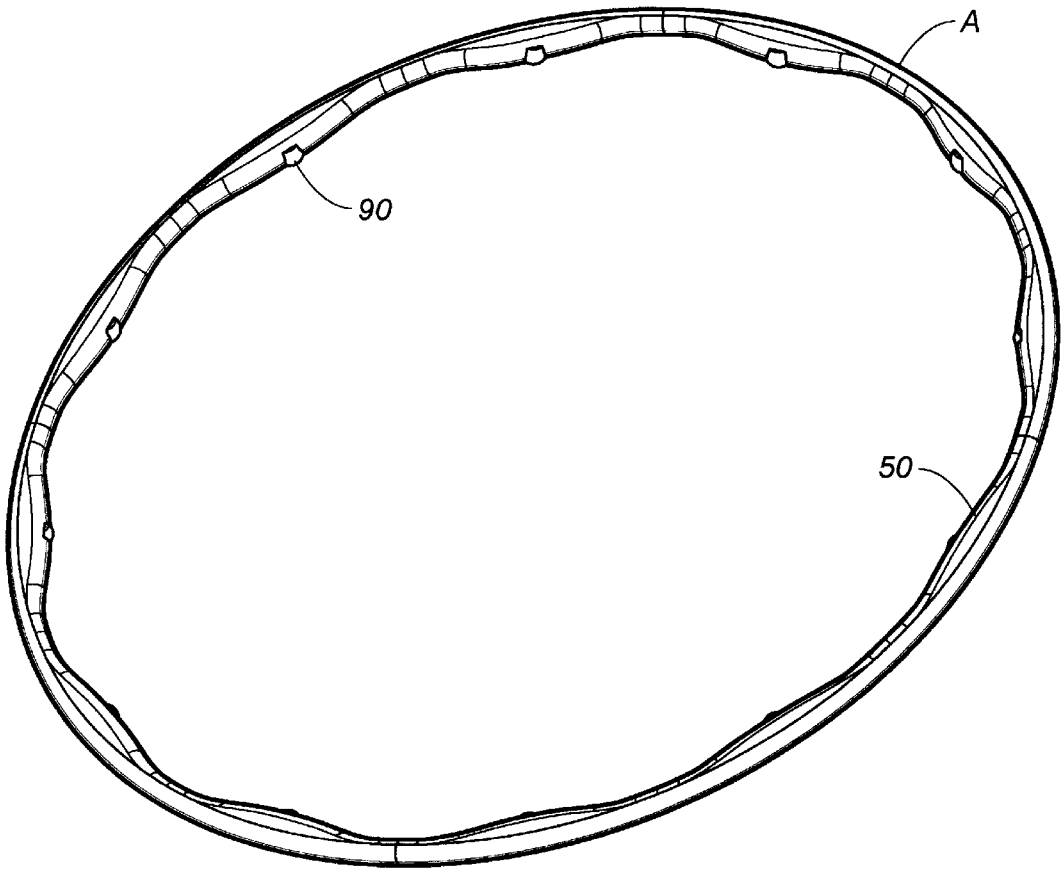
FIG. 2 is a perspective view of the present invention.

As shown in FIG. 2, a perspective view of the present invention, the most obvious difference between a collar body (A) of the present invention and the prior art lies in that a plurality of rotary balls (90) are set in the arc body on the inner side of the hoop. The present invention has some corresponding are units mono-block molded of plastics which can be pivoted and assembled to form a hoop. It takes more time to assemble a finished product, but it only needs a mode much smaller in size so that it can be less costly to produce.

Figure 3:
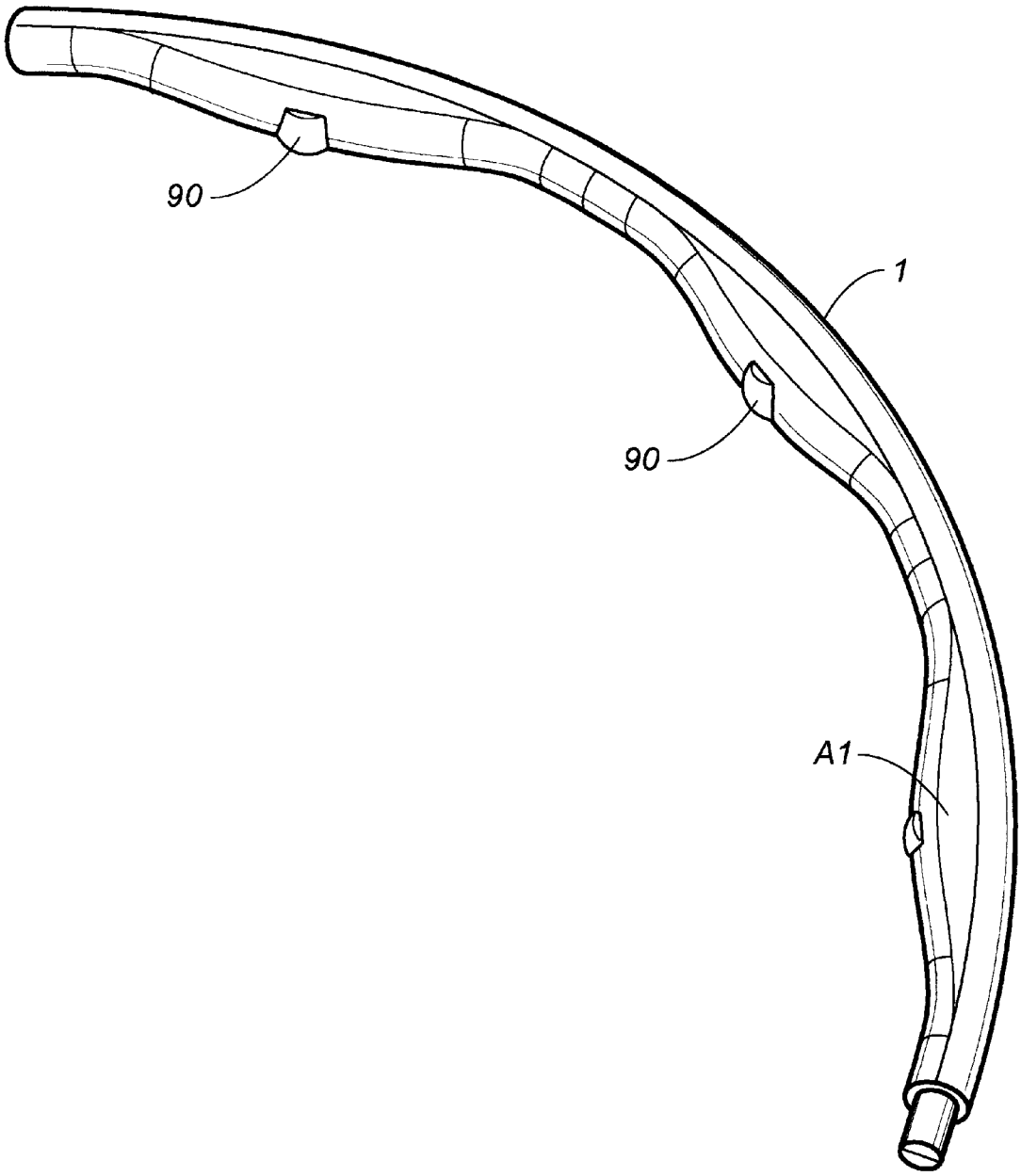
FIG. 3 is a schematic view of the arc units of the invention.
Figure 4:
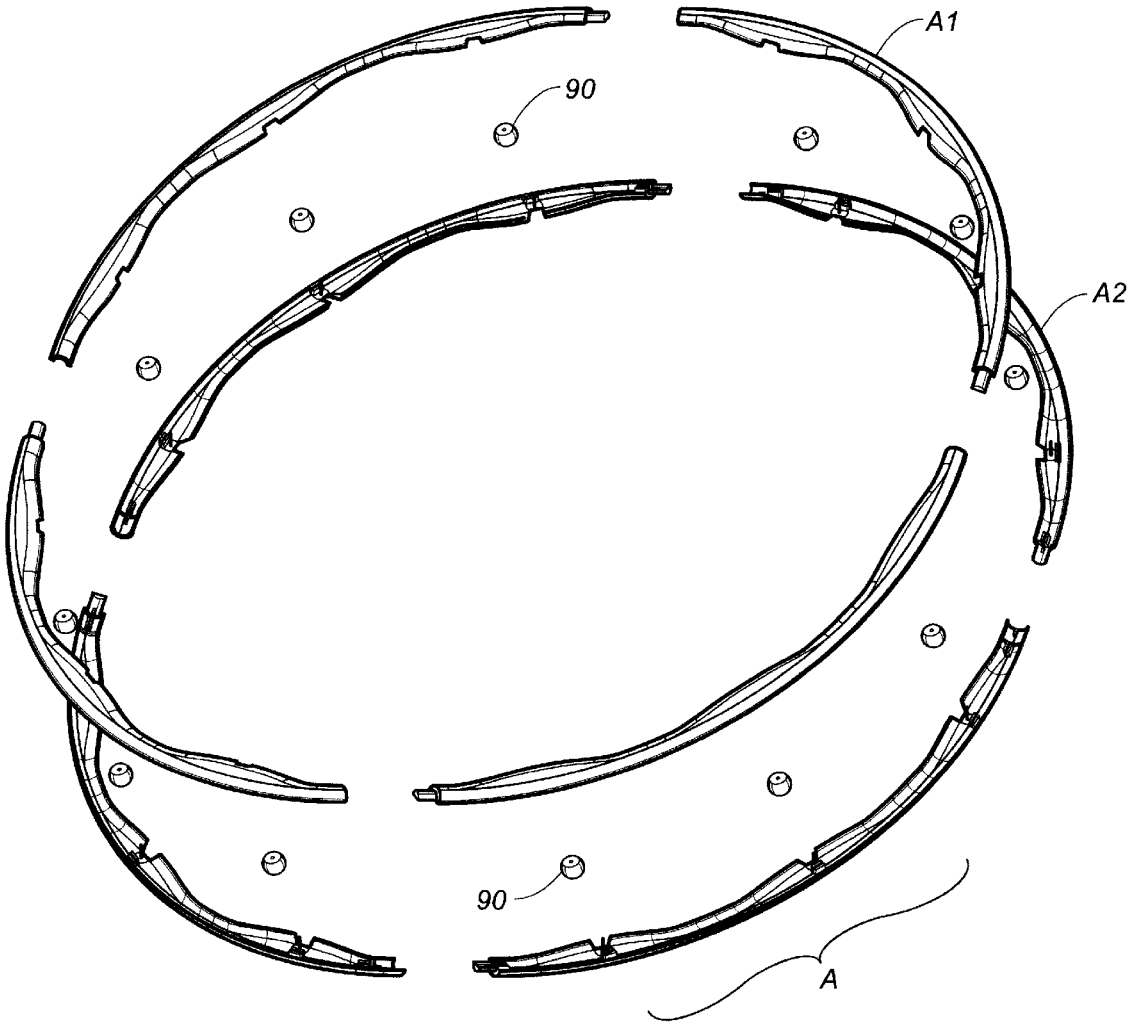
FIG. 4 is a sectional view of the present invention.
Figure 5:
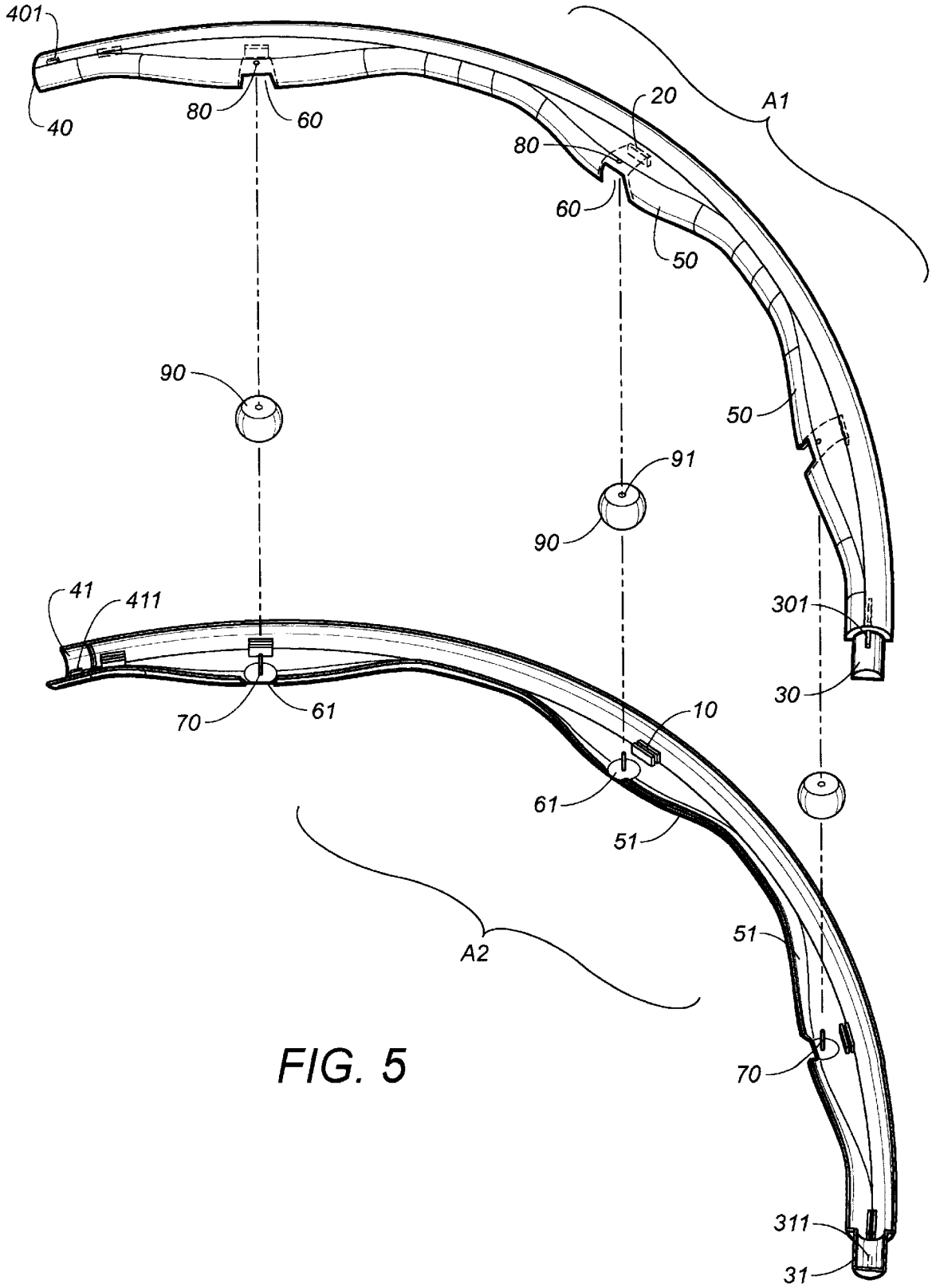
FIG. 5 is an illustrative view of structure of the invention in detail.

According to assemblage concept on non-monoblock molding, the assemblage of the present invention, as shown in FIG. 3, is to connect and combine 4 pairs of corresponding arc units (A1, A2) to form a hoop, as shown in FIG. 4, a plurality of rotary balls are respectively disposed in each pair of arc units (A1,A2). Its structure in detail is shown in FIG. 5, one of the corresponding arc units (A1) has a fastening hook (10) on its inner wall and the other one (A2) has an insertion hook (20) at its corresponding position on its inner wall, when these two corresponding arc units (A1, A2) are firmly fastened and combines, they become an arc frame (1); in order to connect four arc frames (1) to form a round collar body (A), each arc frame (1) has a tenon (30, 31) and mortise (40, 41) at its either end respectively; moreover, the tenon (30, 31) has a hook slot (301, 311) on it and the mortise (40, 41) has a hook chisel (401, 411) on it so as to position and fasten the arc bodies so firmly with each other that they will not be easily taken apart. The present invention has a plurality of undulated arc structures (50) on the inner side of the arc frame (1) combined by a pair of corresponding arc units (A1,A2) and the arc body (1) has a ball slot (60, 61) to accommodate the rotary ball (90), the column (70) in the ball slot (60) in the arc unit (A2) can penetrate a penetration hole (91 ) in the rotary ball (90) so that the ball can rotate between the column (70) of unit (A2) and the column slot (80) of the unit (A1).

The present invention uses combination arc units (A1,A2) of small size to combine and connect firmly together to form a hula hoop of large size; so it needs no mode in large size and can save much cost. And it can provide a great variety of colors and designs by arc units in different color and design so that the consumer may have many choices. The combination structure of the present invention has a plurality of rotary balls (90) disposed in the undulating inner surfaces of the arc frames (1), the balls can increase the rotation fluency when the hula hoop rotates on one's waist or hip and can provide a massage function on one's body.

I claim:

1. A hula hoop comprising:

a plurality of arc frames joined in end-to-end relation so as to have a circular configuration, each of said plurality of arc frames having a top arc unit mechanically affixed to a bottom arc unit, each of said plurality of arc frames having an undulating inner surface, said undulating inner surface having a spherical ball rotatably mounted therein so as to have a surface extending outwardly of said inner surface.

2. The hula hoop of claim 1, each of said plurality of arc frames having a tenon at one end and a mortise at an opposite end, the tenon of one said plurality of arc frames being received within the mortise of an adjacent arc frame.

3. The hula hoop of claim 1, said top arc unit being snap-fitted to said bottom arc unit.

* * * * *